US010264926B2

(12) United States Patent
Ciavarella et al.

(10) Patent No.: US 10,264,926 B2
(45) Date of Patent: Apr. 23, 2019

(54) COLLAPSIBLE LIQUID CONTAINER, FLUID DISPENSER FOR COLLAPSIBLE LIQUID CONTAINER, AND METHOD FOR MAKING COLLAPSIBLE LIQUID CONTAINER

(71) Applicant: GOJO Industries, Inc., Akron, OH (US)

(72) Inventors: Nick Ermanno Ciavarella, Seven Hills, OH (US); Keith Allen Pelfrey, Wadsworth, OH (US)

(73) Assignee: GOJO INDUSTRIES, INC., Akron, OH (US)

( * ) Notice: Subject to any disclaimer, the term of this patent is extended or adjusted under 35 U.S.C. 154(b) by 0 days.

(21) Appl. No.: 15/014,494

(22) Filed: Feb. 3, 2016

(65) Prior Publication Data

US 2016/0220078 A1 Aug. 4, 2016

Related U.S. Application Data

(60) Provisional application No. 62/111,800, filed on Feb. 4, 2015.

(51) Int. Cl.

| | |
|---|---|
| ***A47K 5/122*** | (2006.01) |
| ***B05B 11/00*** | (2006.01) |
| *B05B 12/12* | (2006.01) |

(52) U.S. Cl.

CPC ..... *A47K 5/122* (2013.01); *B05B 11/00412* (2018.08); *B05B 12/122* (2013.01)

(58) Field of Classification Search

CPC ... A47K 5/122; B05B 11/0043; B05B 12/122; B67D 1/06; B67D 1/0001; B67D 1/0462; B67D 1/0216; B67D 1/0255

USPC ..... 222/95, 106, 185.1, 181.1, 108

See application file for complete search history.

(56) References Cited

U.S. PATENT DOCUMENTS 1,734,821 A * 11/1929 Miller ..... A47G 19/24 220/86.1
1,933,517 A * 10/1933 Tucker ..... B60N 3/18 222/108
2,054,881 A * 9/1936 Saunders ..... G01F 11/003 222/181.1

(Continued)

FOREIGN PATENT DOCUMENTS

WO 2014065728 A1 5/2014

*Primary Examiner* — Benjamin R Shaw

(74) *Attorney, Agent, or Firm* — Cooper Legal Group, LLC

(57) ABSTRACT

A collapsible liquid container for a fluid dispenser is provided and includes an upper wall, a collapsible sidewall, a bottom wall, fluid, and a dispensation mechanism. The upper wall, the collapsible sidewall, and the bottom wall cooperate to define a pressurized liquid reservoir. The fluid is contained within the liquid reservoir. A fluid dispenser includes a housing, a collapsing member, and a biasing member. The housing comprises an upper container portion and a support portion. The upper container portion at least partially defines an interior chamber for receiving the collapsible liquid container. The support portion extends downwardly from the upper container portion. The collapsing member is disposed within the interior chamber and is movably coupled with the upper container portion. The biasing member is coupled with the collapsing member and the housing and is configured to bias the collapsing member toward the dispensation zone.

16 Claims, 7 Drawing Sheets

(56) References Cited

U.S. PATENT DOCUMENTS 2,096,397 A * 10/1937 Harris ..... A47K 5/1211 222/372
2,176,988 A * 10/1939 Cameron ..... A47F 1/03 222/185.1
2,432,025 A * 12/1947 Lorenz ..... B64D 37/06 137/590
2,702,655 A * 2/1955 Lopata ..... F04B 9/02 222/146.1
2,715,979 A * 8/1955 Leonard ..... B65D 35/28 222/101
2,865,419 A * 12/1958 Cunningham ..... B65D 37/00 383/109
3,871,554 A * 3/1975 Huck ..... A61H 35/02 222/340
4,136,802 A 1/1979 Mascia et al.
4,165,821 A * 8/1979 Martin ..... A47J 31/401 222/129.4
4,258,865 A 3/1981 Vahl et al.
4,447,232 A 5/1984 Sealfon et al.
5,251,787 A 10/1993 Simson
5,323,932 A 6/1994 Bauman
5,556,005 A 9/1996 Banks
5,904,272 A 5/1999 Kaufman et al.
5,918,767 A * 7/1999 McGill ..... A23G 3/28 222/105
6,135,320 A * 10/2000 Parsons ..... A47K 5/1211 222/214
6,202,893 B1 * 3/2001 Rufini ..... A47K 5/1211 222/103
6,755,325 B2 6/2004 Haase et al.
7,086,568 B1 * 8/2006 Cheek ..... B65D 35/565 222/103
8,042,710 B2 10/2011 van der Heijden
8,201,707 B2 6/2012 Ophardt
8,651,337 B2 2/2014 Quinlan, Jr. et al.
2003/0075562 A1 * 4/2003 Gerenraich ..... A47K 5/1207 222/95
2003/0075565 A1 * 4/2003 Gerenraich ..... A47K 5/1217 222/207
2004/0074921 A1 4/2004 Lips et al.
2004/0226962 A1 * 11/2004 Mazursky ..... A47K 5/1217 222/95
2008/0023487 A1 1/2008 Douwes
2009/0120956 A1 * 5/2009 De La Fe Dahlin ..... B67D 1/0001 222/95
2009/0308888 A1 12/2009 Dairaku et al.
2010/0059544 A1 * 3/2010 Dijkstra ..... B65D 83/0077 222/95
2010/0213210 A1 * 8/2010 Drennow ..... B67D 1/0001 222/82
2012/0104020 A1 * 5/2012 Cur ..... B67D 1/0001 222/1
2012/0111885 A1 * 5/2012 Binderbauer ..... A47K 5/1217 222/52
2012/0273519 A1 * 11/2012 Marshall ..... B67D 7/04 222/52
2013/0221030 A1 * 8/2013 Middleton ..... B67D 3/00 222/103
2013/0294711 A1 11/2013 Stanley et al.
2014/0021221 A1 * 1/2014 Derby ..... B65D 21/08 222/95
2014/0166650 A1 * 6/2014 Kanfer ..... B05B 11/0045 220/6
2015/0060486 A1 * 3/2015 Gamburg ..... B65D 85/78 222/95
2015/0274375 A1 * 10/2015 Kling ..... B65D 35/28 222/103
2015/0315004 A1 * 11/2015 Meinzinger ..... B67D 1/0001 222/95

* cited by examiner

COLLAPSIBLE LIQUID CONTAINER, FLUID DISPENSER FOR COLLAPSIBLE LIQUID CONTAINER, AND METHOD FOR MAKING COLLAPSIBLE LIQUID CONTAINER

TECHNICAL FIELD

A fluid dispenser includes a collapsing member that facilitates collapsing of a collapsible liquid container disposed in the fluid dispenser.

BACKGROUND

A collapsible soap container can be provided in a soap dispenser for dispensing soap onto a user's hands. As the soap depletes, the collapsible soap container collapses. Some conventional fluid dispensers include a collapsing mechanism that applies force to the collapsible soap container to aid in the dispensation of soap therefrom. However, even when the collapsible soap container is completely collapsed, residual soap remains in the collapsible soap container and is incapable of being dispensed therefrom.

SUMMARY

In accordance with one embodiment, a fluid dispenser comprises a housing, a collapsing member, and a biasing member. The housing comprises an upper container portion and a support portion. The upper container portion at least partially defines an interior chamber for receiving a collapsible liquid container. The upper container portion is configured to dispense fluid therefrom. The support portion extends downwardly from the upper container portion. The upper container portion and the support portion cooperate to define a dispensation zone beneath the upper container portion and adjacent to the support portion. The collapsing member is at least partially disposed within the interior chamber and is movably coupled with the upper container portion. The collapsing member is configured to engage a collapsible liquid container. The biasing member is coupled with the collapsing member and the housing and is configured to bias the collapsing member toward the dispensation zone. The biasing member is attached to the housing at an attachment location that is beneath the upper containment portion In accordance with another embodiment, a collapsible liquid container for a fluid dispenser is provided and comprises an upper wall, a collapsible sidewall, a bottom wall, fluid, and a dispensation mechanism. The collapsible sidewall is extendible between a fully extended position and a collapsed position. The upper wall, the collapsible sidewall, and the bottom wall cooperate to define a pressurized liquid reservoir. The fluid is contained within the liquid reservoir. The dispensation mechanism is disposed at the bottom wall and is configured to dispense fluid from the liquid reservoir. The pressurized liquid reservoir is maintained at an internal pressure that is greater than an ambient pressure without any external manual force being applied to the collapsible liquid container.

In accordance with yet another embodiment, a method for fabricating a liquid container for a fluid dispenser is provided. The method comprises forming a body of the liquid container, the body comprising an upper wall, a collapsible sidewall, and a bottom wall. The upper wall, the collapsible sidewall, and the bottom wall cooperate to define a liquid reservoir. The method further comprises forming a port on the bottom wall and filling the liquid reservoir with fluid. The method still further comprises pressurizing the liquid reservoir to an internal pressure that is greater than the pressure external to the liquid container and installing a dispensing mechanism onto the port for selectively sealing the port.

In accordance with yet another embodiment, a fluid dispenser assembly comprises a collapsible liquid container and a fluid dispenser. The collapsible liquid container comprises an upper wall, a collapsible sidewall, a bottom wall, fluid, and a dispensation mechanism. The upper wall, the collapsible sidewall, and the bottom wall cooperate to define a liquid reservoir. The fluid is contained within the liquid reservoir. The dispensation mechanism is disposed at the bottom wall and is in fluid communication with the liquid reservoir. The dispensation mechanism is configured to selectively dispense fluid from the liquid reservoir. The fluid dispenser comprises a housing, a collapsing member, and a biasing member. The housing comprises an upper container portion and a support portion. The upper container portion at least partially defines an interior chamber. The collapsible liquid container is disposed within the interior chamber for dispensing fluid therefrom. The support portion extends downwardly from the upper container portion. The upper container portion and the support portion cooperate to define a dispensation zone beneath the upper container portion and adjacent to the support portion. The collapsing member is at least partially disposed within the interior chamber and is movably coupled with the upper container portion. A portion of the collapsing member overlies the upper wall of the collapsible liquid container. A biasing member is coupled with the collapsing member and the housing. The biasing member biases the collapsing member toward the dispensation zone to facilitate collapsing of the collapsible liquid container as fluid is dispensed therefrom.

BRIEF DESCRIPTION OF THE DRAWINGS

Various embodiments will become better understood with regard to the following description, appended claims and accompanying drawings wherein:

DETAILED DESCRIPTION

Figure 1:
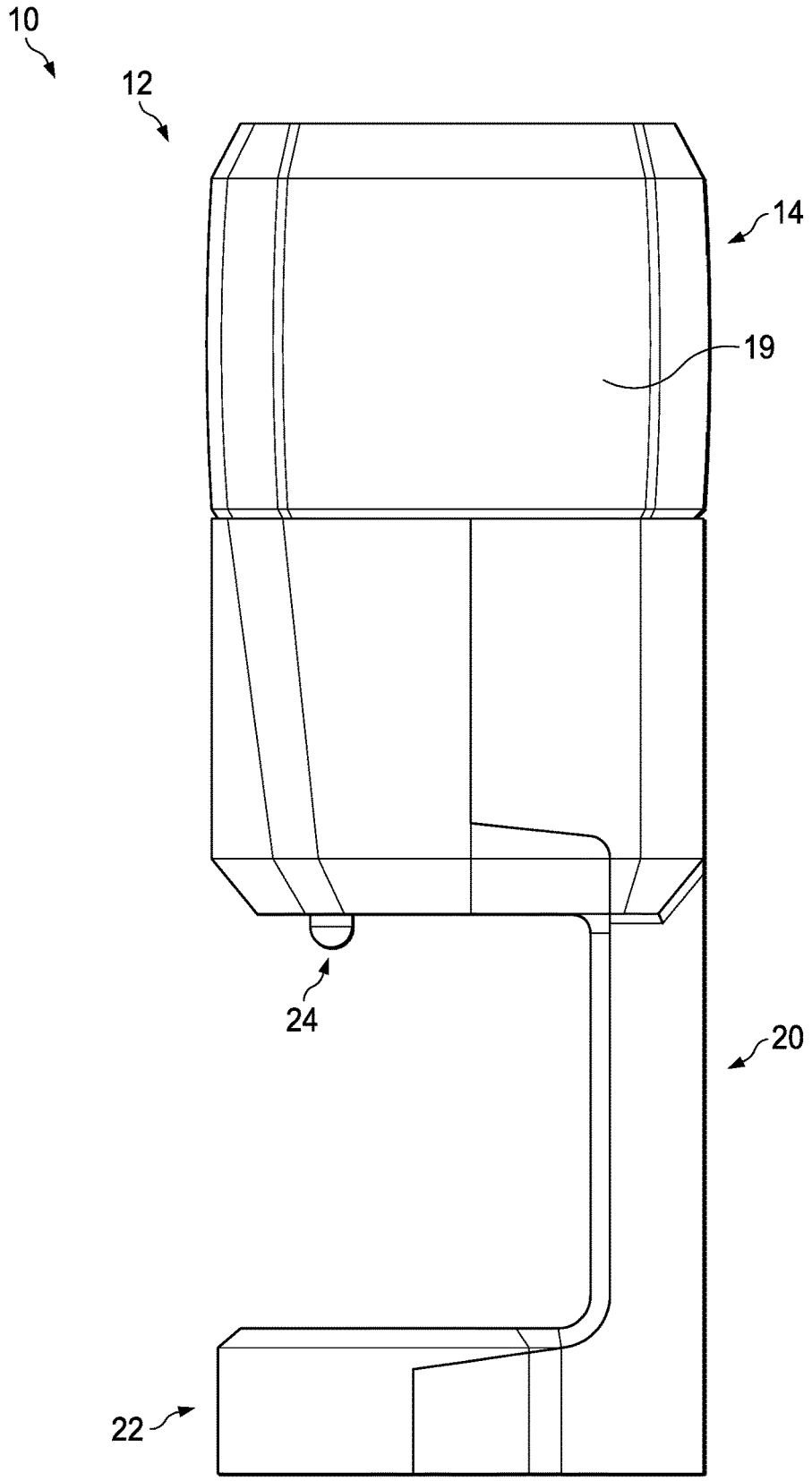
FIG. 1 is side view depicting a fluid dispenser, according to one embodiment.
Figure 2:
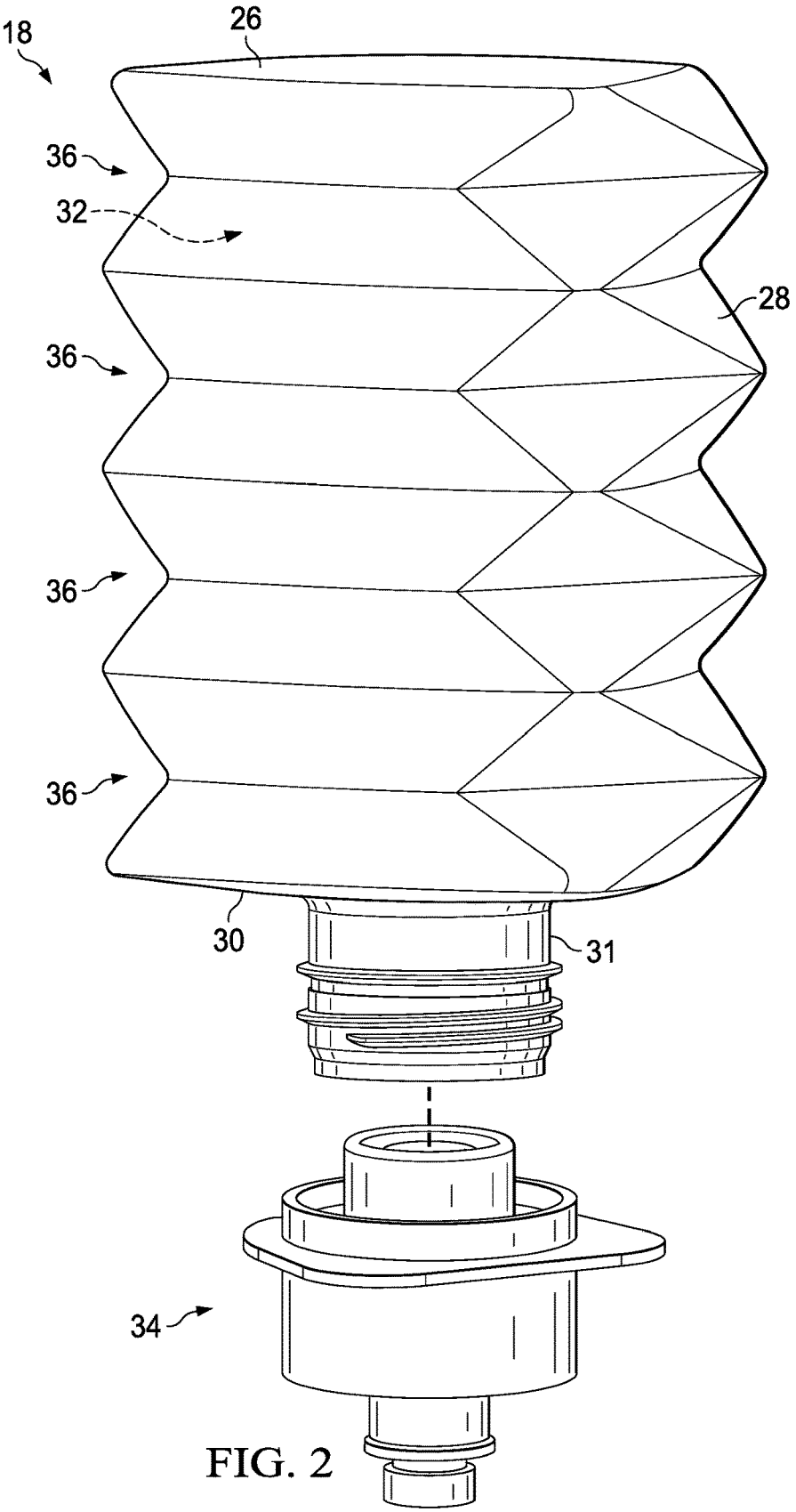
FIG. 2 is a perspective view depicting a liquid container for the fluid dispenser of FIG. 1.

Embodiments are hereinafter described in detail in connection with the views of FIGS. 1-7, wherein like numbers indicate the same or corresponding elements throughout the views. FIG. 1 illustrates a fluid dispenser 10 which can dispense a variety of different types of fluids or liquids, such as, for example, soap, sanitizer, soil removing cleaner, lotion, shampoo, or conditioner, to the hands of a user. The fluid dispenser 10 can include a housing 12 that includes an upper container portion 14 that at least partially defines an interior chamber 16 (FIG. 3) for receiving a liquid container 18 (FIG. 2). The housing 12 can include a lid 19 that is selectively removable from the rest of the housing 12 to permit selective installation into the interior chamber 16. A support portion 20 can extend downwardly from the upper container portion 14 and a drip tray 22 can extend outwardly from the support portion 20 such that the drip tray 22 underlies the upper container portion 14. The upper container portion 14, the support portion 20, and the drip tray 22 can cooperate to define a dispensation zone Z1 (FIGS. 3 and 4) beneath the upper container portion 14. A proximity sensor 24 or other detection device can detect the presence of a user's hands within the dispensation zone Z1 and can facilitate dispensation of fluid from the liquid container 18 within the interior chamber 16 and onto the user's hands. Any fluid that does not remain on the user's hands can be collected onto the drip tray 22 below. In an alternative embodiment, a user can actuate the fluid dispenser 10 by manually actuating a push bar (not shown) that facilitates dispensation of fluid onto a user's hands. The proximity sensor 24 can be powered from any of a variety of AC or DC electrical sources, such as, for example, a power cord, a battery, and/or a solar panel.

As illustrated in FIG. 2, the liquid container 18 can include an upper wall 26, a plurality of sidewalls 28, and a bottom wall 30 that cooperate to define a liquid reservoir 32. The bottom wall 30 can include a port 31. A flow pump 34 that is configured to provide a fluid seal and selectively dispense fluid from the liquid reservoir 32 can be installed on the port 31 such that the flow pump 34 is located along the bottom wall 30. When the liquid container 18 is disposed within the upper container portion 14, the flow pump 34 can be associated with a motor (not shown) that can selectively actuate the flow pump 34 to facilitate dispensation of fluid into the dispensation zone Z1. The motor can be powered from any of a variety of AC or DC electrical sources, such as, for example, a power cord, a battery, and/or a solar panel. The flow pump can be a foaming pump, a non-foaming pump, or any of a variety of suitable alternative dispensation mechanisms. Some of these alternative dispensation mechanisms can include a poppet valve or a solenoid valve.

The liquid container 18 can be collapsible (e.g., a bellows-type container). As illustrated in FIG. 2, each of the sidewalls 28 can include a plurality of pleats 36 that allows the liquid container 18 to be collapsed along the sidewalls 28 (e.g., by applying inward opposing forces to each of the upper wall 26 and the bottom wall 30). One example of such a bellows-type container for a fluid dispenser is disclosed in U.S. patent application Ser. No. 13/804,077, which is hereby incorporated by reference herein in its entirety.

Figure 3:
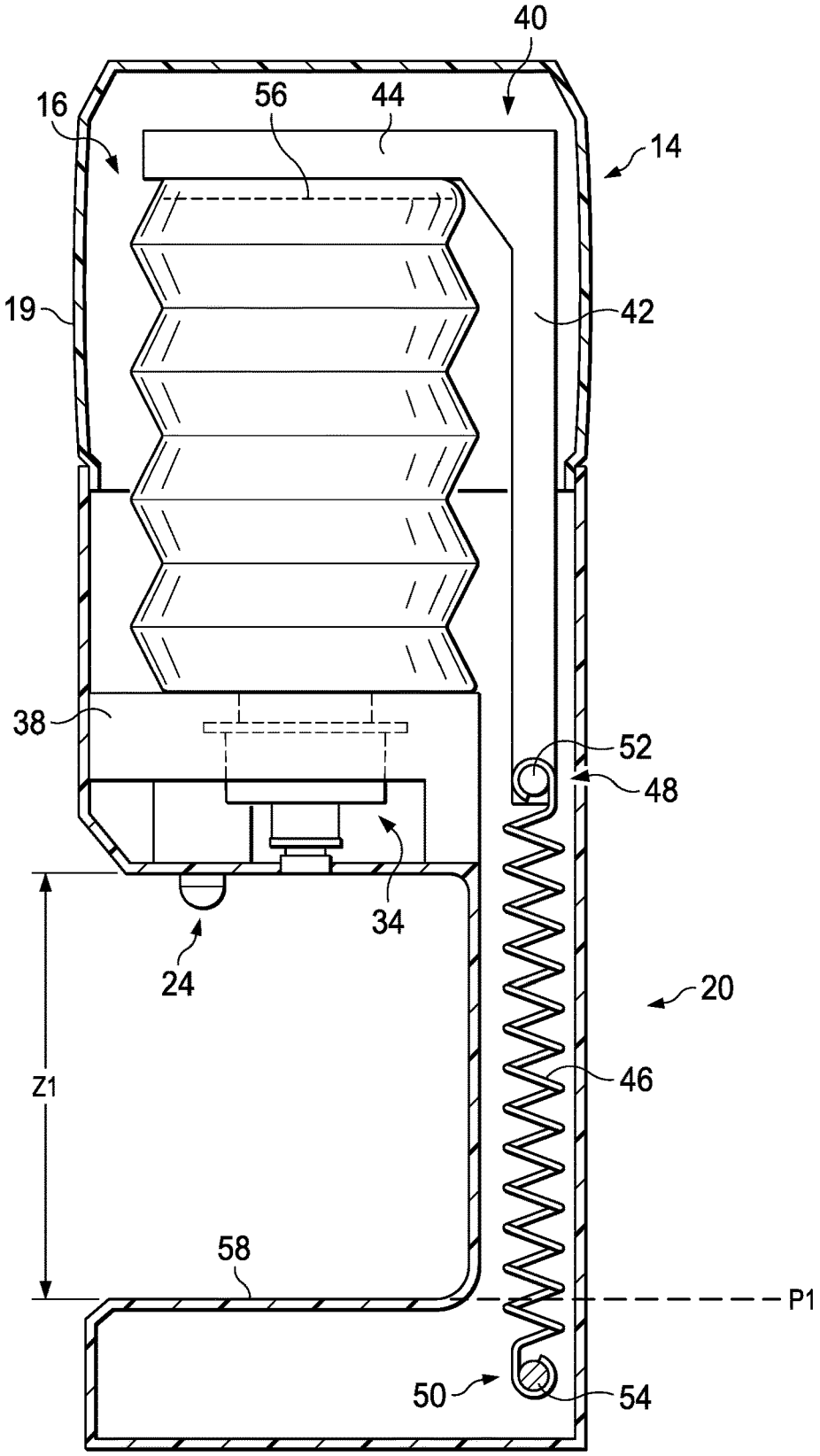
FIG. 3 is a cross section view depicting the fluid dispenser of FIG. 1 and the liquid container of FIG. 2 disposed in the fluid dispenser, wherein a collapsing member is associated with the liquid container and is shown in an extended position with the liquid container in a fully expanded condition.
Figure 4:
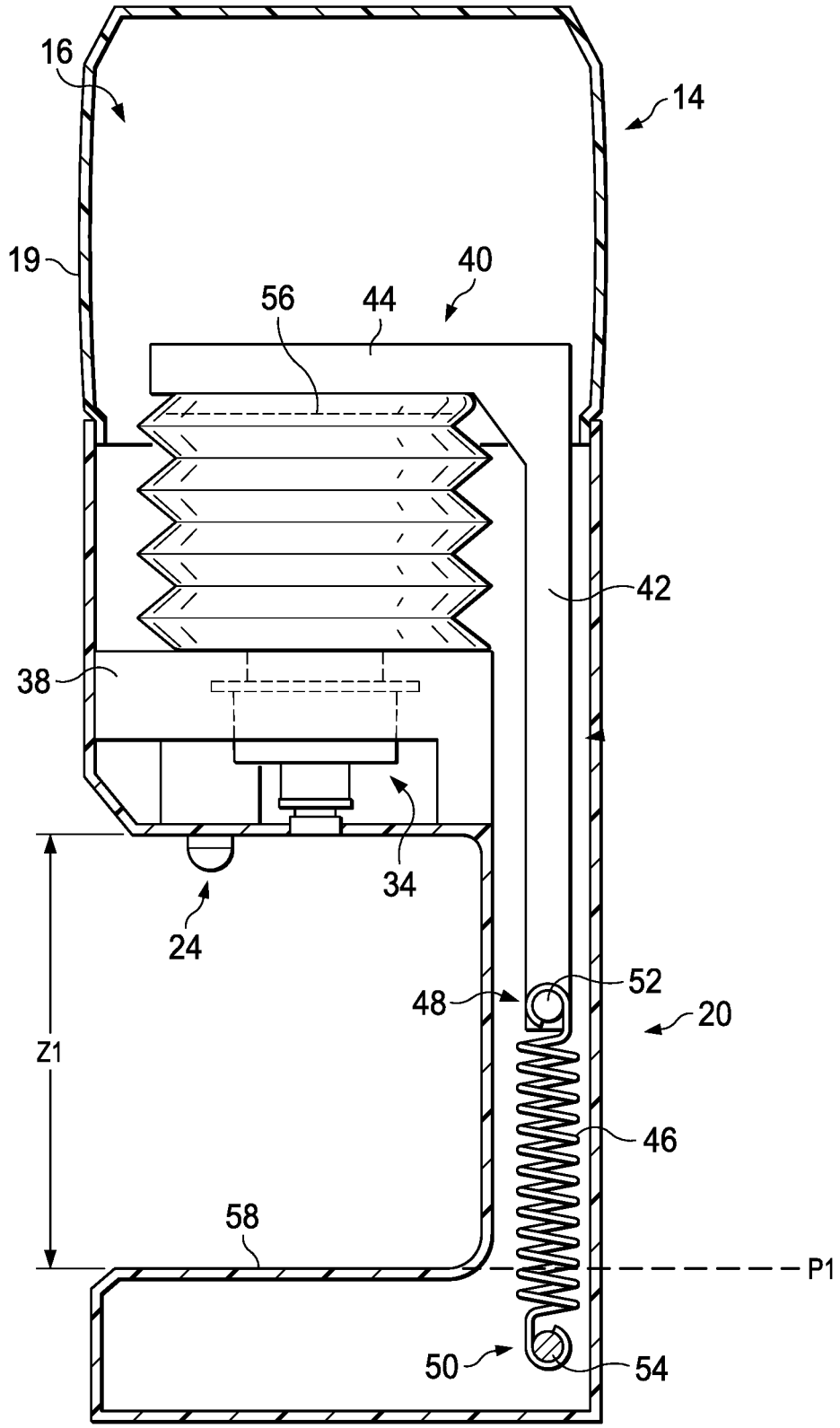
FIG. 4 is cross section view similar to FIG. 3, but with the collapsing member shown in a retracted position and the liquid container in a collapsed condition.

In one embodiment, the liquid reservoir 32 can be pressurized with a pressurization fluid that is less dense (e.g., air) than the fluid that is intended for dispensation from the liquid container 18 (e.g., soap) such that the internal pressure of the liquid reservoir 32 is greater than the pressure external to the liquid container 18 (e.g., the ambient pressure). Once the internal pressure is elevated to an appropriate relative internal temperature, the liquid container 18 can be sealed to maintain the internal pressure relative to the ambient pressure (e.g., during storage). In one embodiment, the liquid reservoir 32 can be pressurized during filling and assembly of the liquid container 18 (e.g., by the manufacturer). In such an embodiment, the liquid reservoir 32 can first be filled with liquid (e.g., soap) through the port 31. Pressurized air can then be imparted to the port 31 (e.g., such as by pressurizing the surrounding environment) to pressurize the liquid reservoir 32 to level that is greater than ambient pressure. While the liquid reservoir 32 is being pressurized, the flow pump 34 can be installed on the port 31 to selectively seal the port 31. With the liquid reservoir 32 sealed, the internal pressure can remain greater than the ambient pressure without any external force being applied to the liquid container 18 (e.g., such as by squeezing the liquid container 18). In some embodiments, the pressurized air can create a headspace 56, as illustrated in FIGS. 3 and 4, between the liquid to be dispensed and the upper wall 26 of the liquid container 18. It is to be appreciated that the liquid container 18 can be pressurized from any of a variety of pressure sources and can include any of a variety of alternative or additional features that allow for pressurization of the liquid reservoir 32 such as, for example, a quick connect fitting installed on one of the walls.

Referring now to FIGS. 3 and 4, the fluid dispenser 10 can include a floor member 38 and a collapsing member 40 that are each disposed within the interior chamber 16 and each configured to engage the liquid container 18 when it is disposed within the interior chamber 16. The collapsing member 40 can include a base member 42 and an elongated arm member 44 that extend away from the base member 42 such that the collapsing member 40 is substantially L-shaped. When the liquid container 18 is installed in the interior chamber 16, as illustrated in FIGS. 3 and 4, the liquid container 18 (e.g., the bottom surface 30) can rest on the floor member 38 with the flow pump 34 extending therethrough to allow for dispensation of fluid to the dispensation zone Z1. The elongated arm member 44 of the collapsing member 40 can overlie the upper wall 26 of the liquid container 18, and the base member 42 can extend downwardly along one of the sidewalls 28.

The collapsing member 40 can be movably coupled with the upper container portion 14 and movable, relative to the floor member 28, between an extended position (FIG. 3) and a retracted position (FIG. 4). As illustrated in FIGS. 3 and 4, the interior chamber 16 can extend into the support portion 20 of the housing 12. When the collapsing member 40 is in the retracted position, a portion of the base member 42 can extend into the support portion 20.

A biasing member can be coupled with the collapsing member 40 and the support portion 20 and can be configured to bias the collapsing member 40 into the retracted position. In one embodiment, the biasing member can comprise a spring 46, as illustrated in FIGS. 3 and 4, having an upper end 48 and a lower end 50. The upper end 48 can be coupled to the base member 42 by a tab 52 that extends from the base member 42 and supports the upper end 48 of the spring 46. The lower end 50 can be coupled to the support portion 20 by a tab 54 that extends from the support portion 20 and supports the lower end 50 of the spring 46. The spring 46 can thus be routed through the lower portion 20 of the housing 12 such that the spring 46 is contained entirely within the interior chamber 16 and thus protected from inadvertent exposure to liquid from the dispensation zone Z1 and/or inadvertent contact with a user's hands or other object. It is to be appreciated that any of a variety of suitable alternative biasing members can be provided for biasing a collapsing member into a collapsed position and thus a collapsible liquid container into a collapsed position. For example, a compression spring (not shown) can be provided in lieu of the collapsing member 40 and the spring 46 between the lid 19 and the upper wall 26 of the liquid container 18.

The collapsing member 40 and the spring 46 can cooperate to collapse the liquid container 18 as the fluid in the liquid reservoir 32 is dispensed and depletes. Routing the spring 46 through the lower portion 20 and attaching the spring 46 at a location that is beneath the dispensation zone Z1 (e.g., below a horizontal plane P1 that intersects an uppermost surface 58 of the drip tray 22 and defines the bottom of the dispensation zone Z1) can allow the spring 46 to be extended further along the height of the fluid dispenser 10, and thus apply a greater force upon the liquid container 18, than conventional, spring-actuated, collapse-type fluid dispensers. This point of attachment can allow the spring 46 to bias the collapsing member 40 with enough force to keep the internal pressure of the liquid reservoir 32 substantially the same (e.g., higher relative to the ambient pressure) throughout the depletion of the liquid and collapsing of the liquid container 18. As such, once the liquid container 18 is completely collapsed, residual fluid remaining in the liquid reservoir 32 can be expelled due to the increased pressure in the liquid reservoir 32 caused by the pressurization fluid. The fluid dispenser 10 and the liquid container 18 thus cooperate to facilitate more effective evacuation of liquid from the liquid container 18 than conventional fluid dispenser/liquid container arrangements.

Figure 5:
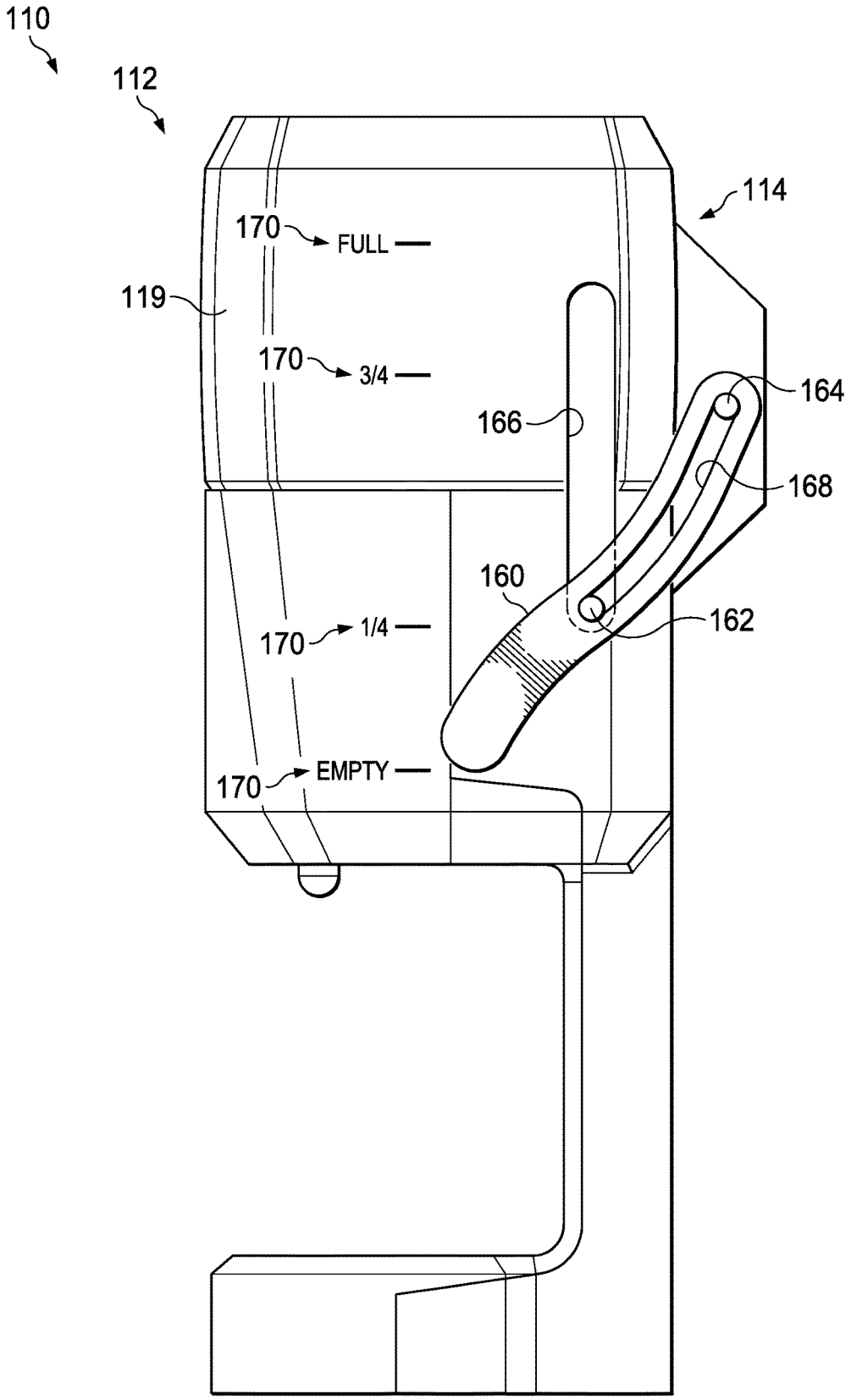
FIG. 5 is side view depicting a fluid dispenser, according to another embodiment.
Figure 6:
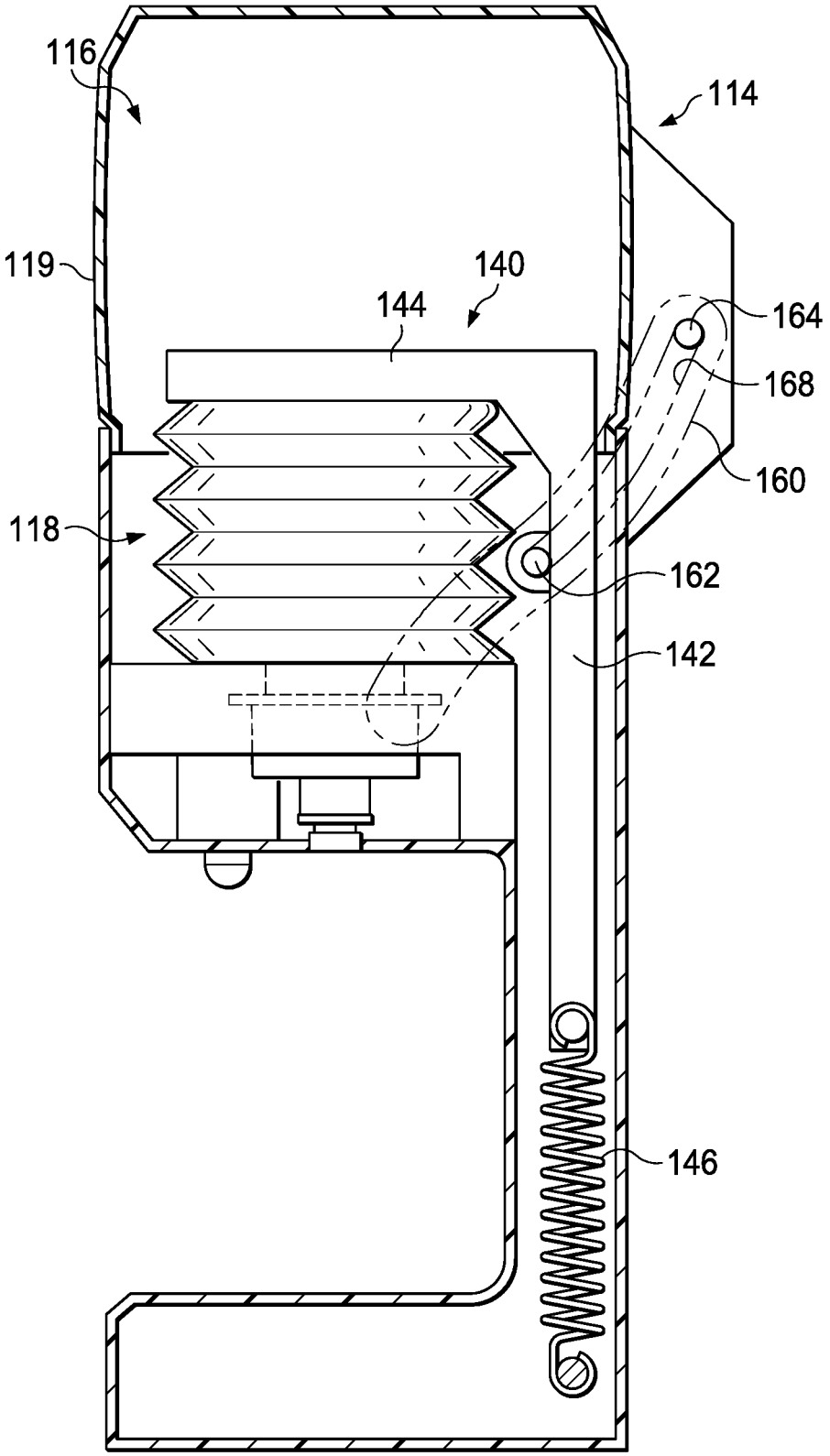
FIG. 6 is a cross section view depicting the fluid dispenser of FIG. 5 and a liquid container disposed in the fluid dispenser, wherein a collapsing member is shown in a collapsed position with the liquid container in a collapsed condition.
Figure 7:
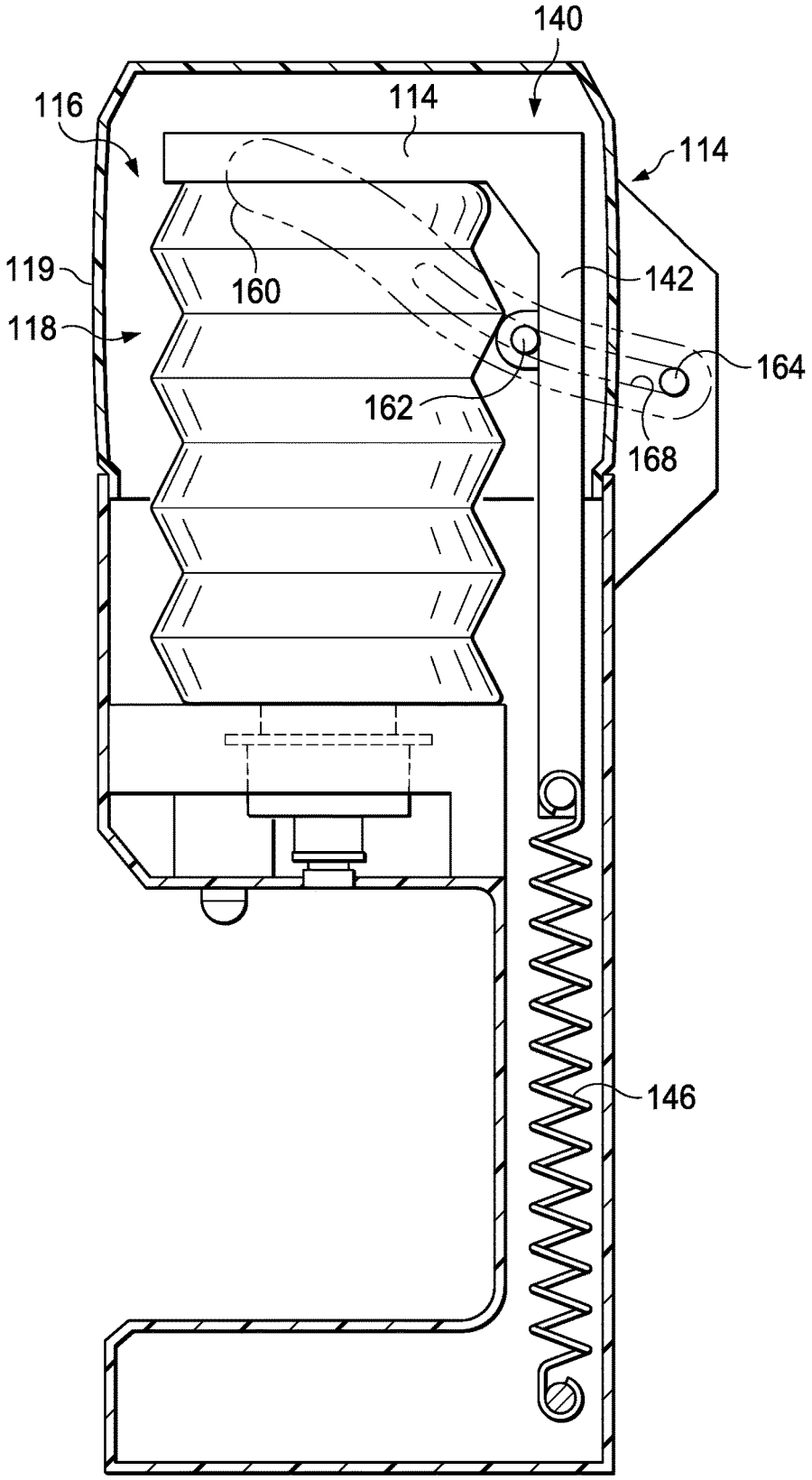
FIG. 7 is cross section view similar to FIG. 6, but with the collapsing member shown in a fully extended position and the liquid container in a fully expanded condition.

An alternative embodiment of a fluid dispenser 110 is shown in FIGS. 5-7. The fluid dispenser 110 can be similar to, or the same as, in many respects as the fluid container 10 of FIGS. 1-4. For example, the fluid dispenser 110 can include a housing 112 having an upper container portion 114 that at least partially defines an interior chamber 116 (FIG. 3) for receiving a liquid container 118. A collapsing member 140 can be disposed within the interior chamber 116 and configured to engage the liquid container 118 when it is disposed within the interior chamber 116. The collapsing member 140 can include a base member 142 and an elongated arm member 144 that extend away from the base member 142 such that the collapsing member 140 is substantially L-shaped. A spring 146 can be provided for biasing the collapsing member 140 into a collapsed position. However, the fluid dispenser 110 can include a lever 160 that is pivotably coupled with each of the collapsing member 140 and the upper container portion 114 with respective pins 162, 164. The lever 160 can be movable between a released position (FIG. 6) and an actuated position (FIG. 7) which can facilitate movement of the collapsing member 140 between the collapsed and extended positions, respectively. The housing 112 and the lever 160 can define respective slots 166, 168 (FIG. 5). When the lever 160 is moved between the collapsed and extended positions, the pin 162 can slide along each of the slots 166, 168 to accommodate for movement of the collapsing member 140 and the lever 160 relative to the housing 112.

Movement of the collapsing member 140 between the collapsed and extended positions can allow for selective removal/installation of the liquid container 118. For example, when the liquid container 118 is depleted (as shown in FIG. 6), a user (i.e., maintenance personnel) can remove a lid 119 and can move the lever 160 into the actuated position to allow access to the depleted liquid container 118. With the lever 160 in the actuated position, the depleted liquid container 118 can be removed and replaced with a new liquid container (as shown in FIG. 7). Once the new liquid container is properly in place, the lever 160 can be released and the spring 146 can bias the elongated arm member 144 into contact with the liquid container 118. In one embodiment, as illustrated in FIG. 5, the housing 112 can be provided with external indicia 170 that indicate the level of the fluid in the fluid container 118 (i.e., FULL, ¾, ¼, or EMPTY) based upon the position of the lever 160.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather it is hereby intended the scope be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A fluid dispenser comprising:

a housing comprising:

an upper container portion that at least partially defines an interior chamber for receiving a collapsible liquid container, the upper container portion being configured to dispense fluid therefrom; and a support portion extending downwardly from the upper container portion, wherein the upper container portion and the support portion cooperate to define a dispensation zone beneath the upper container portion and adjacent to the support portion;

a collapsing member disposed at least partially within the interior chamber and movably coupled with the upper container portion, the collapsing member being configured to engage the collapsible liquid container, the collapsing member comprising:

a base member having a first base end and a second base end, the base member having a height between the first base end and the second base end; and an elongated arm member that overlies the collapsible liquid container, the elongated arm member coupled with the first base end of the base member and extending non-parallel to a direction of the height of the base member; and a biasing member coupled with the second base end of the base member and the housing and configured to bias the collapsing member toward the dispensation zone, the biasing member being attached to the housing at an attachment location that is beneath the upper container portion, wherein the height of the base member remains constant as the collapsing member moves towards the dispensation zone due to the bias.

2. The fluid dispenser of claim 1 further comprising a drip tray extending outwardly from the support portion beneath the upper container portion, wherein the drip tray cooperates with the upper container portion and the support portion to define the dispensation zone.

3. The fluid dispenser of claim 1 wherein the biasing member comprises a spring having a first end and a second end, the first end being coupled with the collapsing member and the second end being coupled with the support portion.

4. The fluid dispenser of claim 1 wherein the attachment location is beneath the dispensation zone.

5. The fluid dispenser of claim 3 wherein the collapsing member comprises a first tab, the support portion comprises a second tab, and the first end and second end of the spring are coupled with the first tab and the second tab, respectively.

6. The fluid dispenser of claim 1 wherein the collapsing member is substantially L-shaped.

7. A fluid dispenser assembly comprising:

a collapsible liquid container comprising:

an upper wall;

a collapsible sidewall;

a bottom wall, wherein the upper wall, the collapsible sidewall, and the bottom wall cooperate to define a liquid reservoir;

fluid contained within the liquid reservoir; and a dispensation mechanism disposed at the bottom wall and in fluid communication with the liquid reservoir, wherein the dispensation mechanism is configured to selectively dispense fluid from the liquid reservoir;

a fluid dispenser comprising:

a housing comprising:

an upper container portion that at least partially defines an interior chamber, the collapsible liquid container being disposed within the interior chamber for dispensing fluid therefrom; and a support portion extending downwardly from the upper container portion, wherein the upper container portion and the support portion cooperate to define a dispensation zone beneath the upper container portion and adjacent to the support portion;

a collapsing member at least partially disposed within the interior chamber and movably coupled with the upper container portion, wherein a portion of the collapsing member overlies the upper wall of the collapsible liquid container; and a biasing member coupled with the collapsing member and the housing, wherein the biasing member is coupled to the housing at a location below the dispensation mechanism and biases the collapsing member toward the dispensation zone to facilitate collapsing of the collapsible liquid container as fluid is dispensed therefrom.

8. The fluid dispenser assembly of claim 7 further comprising a drip tray extending outwardly from the support portion beneath the upper container portion, wherein the drip tray cooperates with the upper container portion and the support portion to define the dispensation zone.

9. The fluid dispenser assembly of claim 7 wherein the collapsing member comprises a base member and an elongated arm member, and the elongated arm member overlies the upper wall of the collapsible liquid container.

10. The fluid dispenser assembly of claim 9 wherein the biasing member comprises a spring having a first end and a second end, the first end being coupled with the base member of the collapsing member and the second end being coupled with the support portion.

11. The fluid dispenser assembly of claim 10 wherein the base member of the collapsing member comprises a first tab, the support portion comprises a second tab, and the first end and second end of the spring are coupled with the first tab and the second tab, respectively.

12. The fluid dispenser assembly of claim 7 wherein the dispensation mechanism comprises a flow pump.

13. The fluid dispenser assembly of claim 7 further comprising a lever pivotally coupled with the collapsing member and configured to facilitate movement of the collapsing member between an extended position and a collapsed position.

14. The fluid dispenser assembly of claim 7 wherein the liquid reservoir is at an internal pressure that is greater than a pressure ambient to the collapsible liquid container without any external force being applied to the collapsible liquid container.

15. A fluid dispenser comprising:

a housing comprising:

an upper container portion that at least partially defines an interior chamber for receiving a collapsible liquid container; and a support portion extending downwardly from the upper container portion, wherein the upper container portion and the support portion cooperate to define a dispensation zone beneath the upper container portion and adjacent to the support portion;

a collapsing member disposed at least partially within the interior chamber and configured to engage the collapsible liquid container;

a biasing member coupled with the collapsing member and the housing and configured to bias the collapsing member in a first direction toward the dispensation zone to urge the collapsible liquid container to a collapsed state and facilitate dispensing of fluid from the collapsible liquid container into the dispensation zone; and a lever coupled with the collapsing member and configured to counter the bias of the biasing member to urge the collapsible liquid container in a second direction to an uncollapsed state, wherein the lever is coupled at a first location of the collapsing member and the biasing member is coupled at a second location of the collapsing member, the first location spaced apart from the second location.

16. The fluid dispenser of claim 15, wherein the second direction is opposite the first direction.

* * * * *